US008636488B2

(12) United States Patent
Fenger

(10) Patent No.: US 8,636,488 B2
(45) Date of Patent: Jan. 28, 2014

(54) HYDRAULIC MOTOR OR PUMP

(75) Inventor: Per E. Fenger, Terndrup (DK)

(73) Assignee: Liftra ApS, Aalborg (DK)

( * ) Notice: Subject to any disclaimer, the term of this patent is extended or adjusted under 35 U.S.C. 154(b) by 256 days.

(21) Appl. No.: 13/203,336

(22) PCT Filed: Feb. 17, 2010

(86) PCT No.: PCT/DK2010/050040

§ 371 (c)(1),
(2), (4) Date: Aug. 25, 2011

(87) PCT Pub. No.: WO2010/097086

PCT Pub. Date: Sep. 2, 2010

(65) Prior Publication Data

US 2011/0311388 A1 Dec. 22, 2011

(30) Foreign Application Priority Data

Feb. 25, 2009 (DK) ..... 2009 00267

(51) Int. Cl.
*F03C 4/00* (2006.01)
*F04C 2/00* (2006.01)
*F04C 18/00* (2006.01)

(52) U.S. Cl.
USPC ..... 418/266; 418/173; 418/176; 418/177; 418/259

(58) Field of Classification Search
USPC ..... 418/173–177, 259, 266–268
See application file for complete search history.

(56) References Cited

U.S. PATENT DOCUMENTS

| | | | | | |
|---|---|---|---|---|---|
| 1,769,647 | A | * | 7/1930 | Press | 418/266 |
| 2,006,280 | A | * | 6/1935 | Schlueter | 418/266 |
| 2,819,677 | A | | 1/1958 | Leath | |
| 4,047,857 | A | * | 9/1977 | Fischer | 418/176 |
| 4,098,256 | A | * | 7/1978 | Sieck | 418/266 |

FOREIGN PATENT DOCUMENTS

| | | | | | |
|---|---|---|---|---|---|
| FR | 1 540 472 | A | | 9/1968 | |
| GB | 363471 | A | * | 12/1934 | F04C 18/336 |
| GB | 681 546 | | | 10/1952 | |

OTHER PUBLICATIONS

PCT International Search Report for International Applicaiton No. PCT/DK2010/050040 Dated May 25, 2010 (Form PCT/ISA/210).

* cited by examiner

*Primary Examiner* — Theresa Trieu
(74) *Attorney, Agent, or Firm* — Roberts Mlotkowski Safran & Cole, P.C.; David S. Safran

(57) ABSTRACT

A hydraulic motor or pump (2) that generates a relatively high torque, and further allows an unprecedented high specific displacement that makes the motor suitable yaw motor for large wind turbines of horizontal axis wind turbines or wheel yaw motor on Heavy Carriers. The characteristic by the hydraulic motor or pump (2) is that if the number of barriers in the annular cavity (12) of engine or pump is n then the number of radial displaceable sliders (20) will be larger than (n+1).

6 Claims, 3 Drawing Sheets

HYDRAULIC MOTOR OR PUMP

BACKGROUND OF THE INVENTION

1. Field of the Invention

The present invention relates to a hydraulic motor or pump, comprising a first and a second body which in association with definitive boundaries limits an annular cavity with a constant cross-section opening in relation to the centre of the annular cavity, where the first body is static and the second body is rotatable, or vice versa, and where the annular cavity is connected with passages respectively to a hydraulic pressure side and a pressure neutral side, and where the first and the second body comprises evenly spaced radial projecting protrusions which connects the bodies and divides up the annular cavity in a number of chambers which alternately are put on hydraulic pressure and are pressure neutral.

2. Description of Related Art

Such a device is disclosed in French Patent FR 1 540 472 where pressurizing of the chambers in the annular cavity takes place via respective passages to a hydraulic pressure side and a pressure neutral side, by star-shaped spring held valves in the static part, which forms semi-static separations between pressurized chambers and chambers with neutral hydraulic pressure, and where the protrusions on the rotatable body during rotation passes the star-shaped valves rotating the star-shaped spring held valves, which respectively opens and closes the passages to the pressurized side and the pressure neutral side. In the same publication is further shown an embodiment of the device suited for one direction of rotation for the rotatable body, wherein the star-shaped valves are substituted by displaceable sliders. The device is in a manner that if the number of radial outstanding protrusions on the rotor is n, then the number of star-shaped, rotatable mounted valves or sliders will be (n+1).

However, this device shows several drawbacks of which should be mentioned, that the hydro-mechanical losses associated with the friction between the moving mechanical parts is expected to be relative considerable with respect to the embodiment comprising the star-shaped valves. Further, the embodiment comprising the displaceable sliders allows only rotation of the rotor in one direction of rotation, due to the design of the sliders, which limits the abilities of use for this embodiment of the device. The device thus is not suited for macro structures such as yaw motors in windmills, where relatively large torque is required, and that rotation can be implemented in both directions of rotation.

SUMMARY OF THE INVENTION

Thus, it is the object of the present invention to provide a hydraulic motor or pump which offers the possibility for a relatively high torque and which can operate in both directions of rotation around a pivot axis.

This object is achieved by a hydraulic motor or pump of the initially indicated kind, which is characterized in, that the static body comprises a number of radial protrusions being in abutment with the rotatable body, said protrusions being evenly spaced over the annular cavity, by which the annular cavity is divided in a number of chambers, and where the rotatable body comprises a number of evenly spaced radial protruding and radial displaceable sliders being in abutment with the static body and follows the movement of the rotatable body, where the radial protrusions comprises a first passage and a second passage with outflow openings respectively on the first side and the second side of the respective protrusions, said passages respectively being connected to hydraulic high pressure and hydraulic low pressure, and in such manner that the tangential distribution of the passages are adapted the tangential distribution of the sliders, and so that in anytime in each chamber a slider is limiting hydraulic high pressure from hydraulic low pressure, and where the number of sliders represents more than one per. protrusion.

Hereby is achieved a possibility to establish more protrusions on the static body, and thus more chambers, which by the increased number of sliders leads to a better distribution between pressurized chambers and not pressurized chambers, which results in a less radial imbalance between rotor and stator and thus less hydro-mechanical losses. This also leads to a greater stability and balanced operation of the hydraulic motor or pump. A further and more essential advantage associated with the invention is that the motor performs a significant larger torque, as there are more pressurized chambers at a time in the annular cavity, and the displacement velocity for the fluid used in the motor is increased as the number of protrusions, each of which comprising a passage connected with respective hydraulic high pressure and hydraulic low pressure.

Thus it will here be possible to achieve significant improvements of the specific displacement (displacement per. engine volume) by hydraulic motors arranged according to the invention, which, in theory, by optimizing the number of chambers, can reach a specific displacement more than 0.4, compared with the today known hydraulic motors, where the specific displacement is around 0.04 to 0.07.

In a first embodiment of the hydraulic motor or pump, it may be appropriate that the sliders are spring activated to abut against the static body, during their migration between the protrusions, as spring activation is a well known and reliable principle. However, it will be necessary to carry out a radial translation of the sliders when they pass protruding, as will be seen later.

In a second embodiment of the hydraulic motor or pump the sliders may be hydraulically affected to abut against the static object in cavity between two consecutive radial protrusions. Hereby is the pressure the difference between the hydraulic high-pressure side and the hydraulic low-pressure side is exploited to keep the sliders in abutment against the static body.

Since the number of protrusions, and the number of sliders in the interest of optimal specific displacement of the hydraulic motor or pump, according to invention, is preferred relatively large, it is preferred that the extent of the protrusions along the perimeter of the annular cavity is as small as possible, which means that it will not be appropriate that they have sloping side walls. The protrusions will thus be blunt extending, causing the sliders to implement a radial displacement, to pass the protrusions. In that connection it is preferred, in a third embodiment of the hydraulic motor or pump, that the sliders are hydraulically influenced for performance of a radial displacement, so that a current slider during passage of a current protrusion does not affect the sides of a current protrusion.

In a fourth embodiment of the hydraulic motor or pump the sliders may be mechanical/hydraulic influenced to perform radial displacement so that a current slider during passage of a current protrusion does not affect the sides of the protrusion.

In a further embodiment of the hydraulic motor or pump the sliders may be electrical/hydraulic influenced to perform radial displacement, so that a current slider during passage of a current protrusion do not affect the sides of the protrusion.

The invention may, for example, in an embodiment in which it is designed as a hydraulic motor, advantageously be used in wind turbine industry in the yaw mechanism for the horizontal-axis wind turbines. Said type of wind turbines provides an active control of the orientation of the rotor axis, using a yaw mechanism between the tower and nacelle, so that the rotor axis in a controlled manner is oriented up against the wind in a preferred position, with the intent to control the rotor axis, and thus the operation of the wind turbine. The characteristic by such yaw mechanisms is that there is a need for very slow movements, which require strong momentum around the vertical axis. Functionally, it is further necessary to be able to yaw infinite and in both directions around the tower's vertical axis. Considering the leading wind turbine manufacturers wind turbines, these have without exception the same basic solution to the yaw system for wind turbines with a rated power of 0.5 to 5 MW. The principle is based on a positioning of the nacelle relative to the tower so that there is only one degree of freedom (the yaw movement) between the two components. The yaw movement is generated by a ratchet on the tower which interacts with 2-8 synchronized electric gear motors, mounted in the nacelle and engaged with the ratchet. The gear motors are equipped with mechanical brakes and works totally seen as yaw actuators and yaw breaks. The break function is typically supplemented with one or more hydraulic actuated disc brakes.

Here, the use of a macro embodiment of the invention as a hydraulic draw motor could prove to be highly advantageous, since the synchronized gear motors with disc brakes etc. are replaced by a purely hydraulic yaw system that provides the required torque to turn the nacelle and thus wind turbine blades in a desired position relative to wind direction Further the invention advantageously will be useable as wheel yaw motors in connection with "Heavy Carrier" products for transportation of large heavy general cargo.

The above two applications of the hydraulic motor or pump are only to be regarded as examples of the numerous applications the invention presents and may thus not be considered as limiting the scope of protection.

The invention is explained in the following with reference to the accompany drawings.

DETAILED DESCRIPTION OF THE INVENTION

Figure 1:
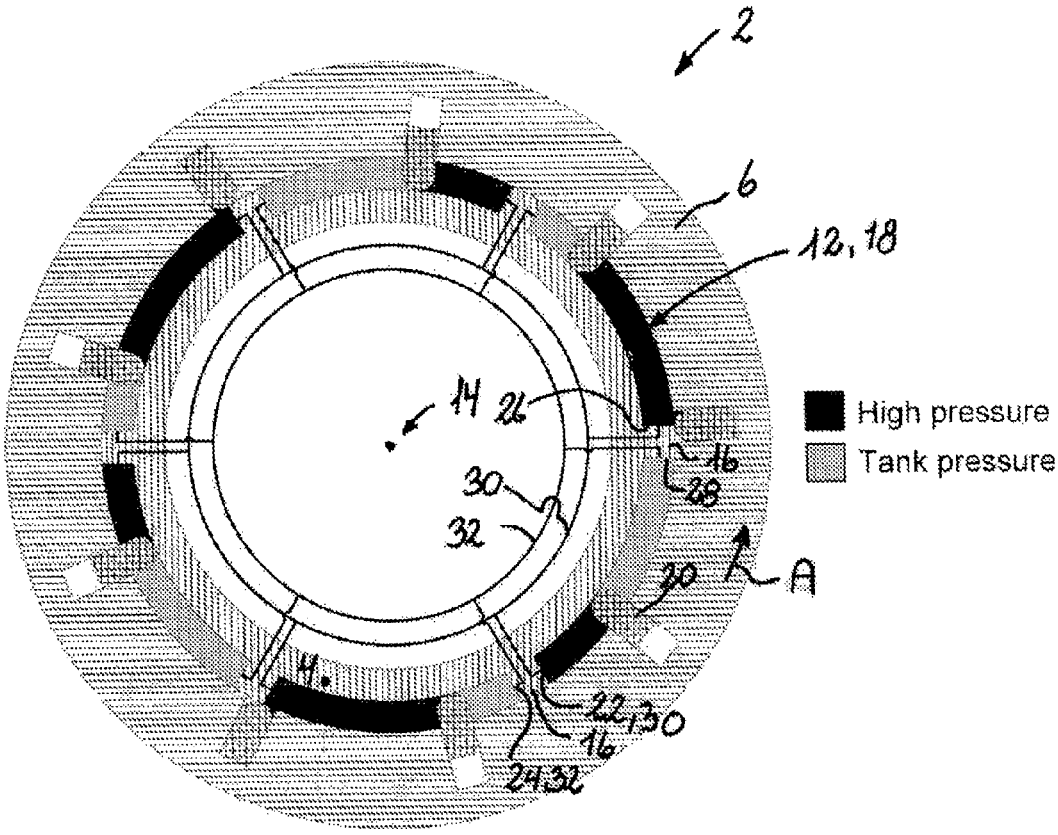
FIG. 1 is a sectional view of a first embodiment of a hydraulic motor or pump, according to the invention in which the static body is located in the centre of mo-sector.

In FIG. 1 shows a first embodiment of a first execution form of a hydraulic motor or pump 2, in the following also randomly named the motor, according to the invention.

Figure 3:
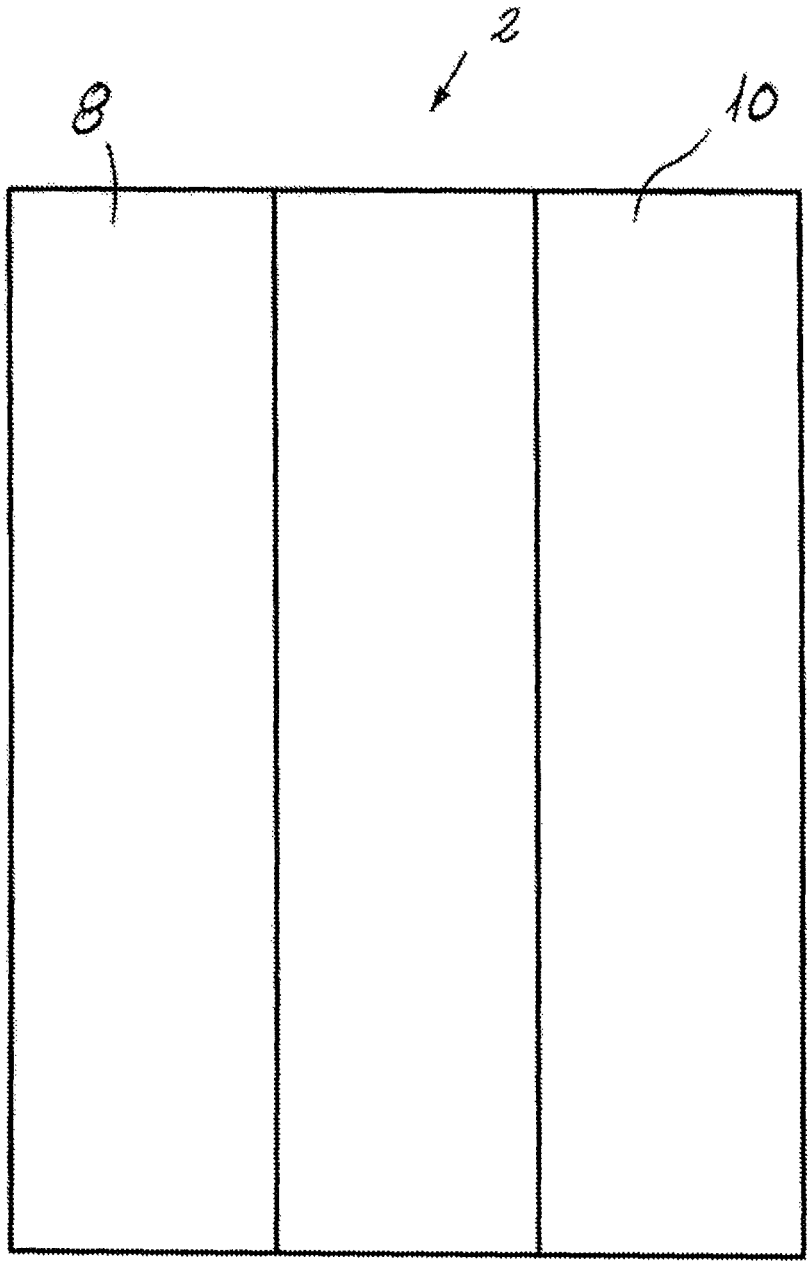
FIG. 3 is a principle side view of FIG. 1 and FIG. 2 showing the end boundaries of the annular cavity

The hydraulic motor or pump 2 includes a first body 4 and a second body 6, which in association with definitive boundaries, 8, 10 (cf. FIG. 3), defines an annular cavity 12 with a constant cross-sectional opening relative to the centre 14 of the annular cavity. In the shown embodiment the first body 4 is static and the second body 6 rotatable also in the following pronounced the rotary body 6.

As it appears in FIG. 1, the first body 4 includes a number of evenly spaced, radial protrusions 16 or barriers in the annular cavity 12, said protrusions 16 being in abutment with the rotatable body 6, whereby the annular cavity 12 divided into a number of chambers 18.

The rotary body 6 includes a number over the annular cavity 12 evenly spaced radial displaceable protruding sliders 20 which are in abutment with the static body 4 and follows the movement of rotary body cf. the direction indicated by the arrow A.

The radial protrusions 16 includes a first passage 22 and a second passage 24 with the outflow openings, respectively on the first side 26 and the second side 28 of the respective protrusions 16, said passages 22, 24 are respectively connected to hydraulic high pressure 30 (black color marking) and hydraulic low pressure 32 (gray color marking) and in a manner that the tangential distribution of the passages are adapted the tangential division of the sliders, by which at any time in each chamber 18 there is a slider 20 which delimits hydraulic high pressure 30 from the hydraulic low pressure 32, and where the number of sliders in total, represent more than one per. protrusion.

Figure 2:
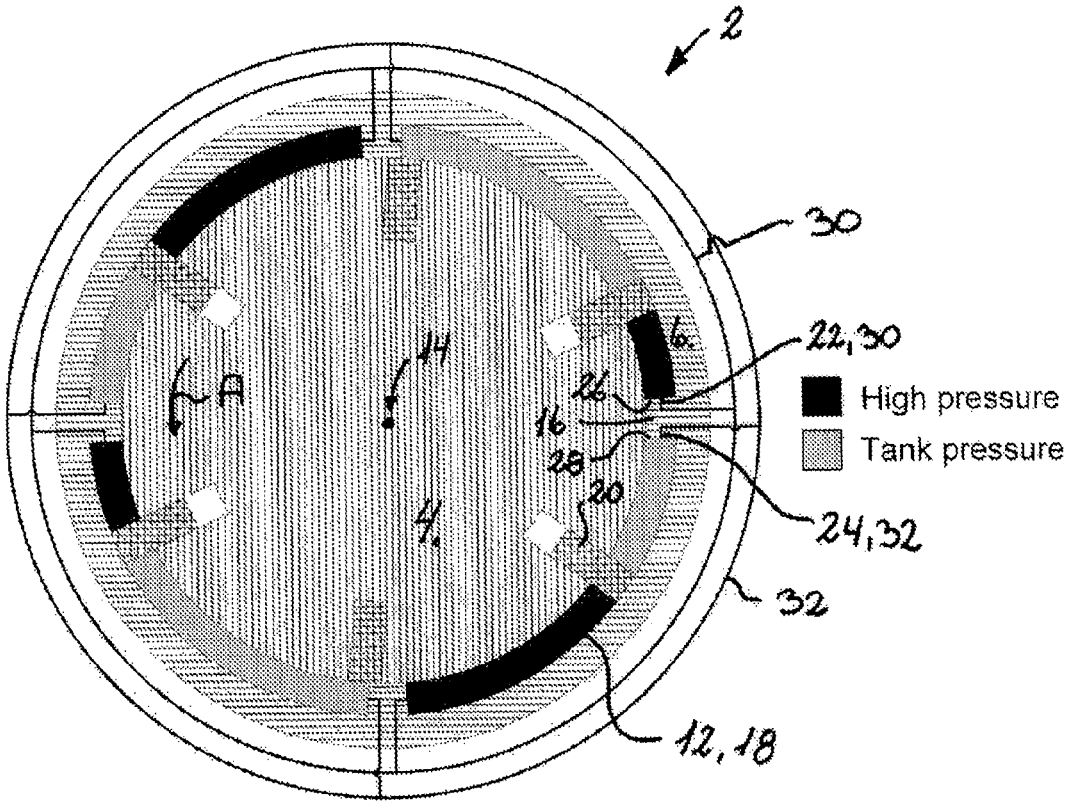
FIG. 2 is a sectional view of a second embodiment of a hydraulic motor or pump, according to the invention in which the static body is located in the periphery of the motor.

In FIG. 2 is shown a second embodiment of a hydraulic motor 2 or pump 2, according to the invention, where the first body 4 is rotatable and the second body 6 is static Again is seen the protrusions 16 extending from the second body 6, being in abutment with the periphery of the first body 4, whereby the annular cavity 12 is divided into a number of chambers 18.

The first body 4, which is now rotatable, also includes a number of evenly spaced radial displaceable protruding sliders 20 in the annular cavity 12, said sliders 20 being in abutment with the static body 6 and follows the movement of rotary body in the direction indicated by the arrow A Also here it appears that the radial protrusions/barriers 16 includes a first passage 22 and a second passage 24 with outflow opening, respectively on the first side 26 and the second side 28 of the respective protrusions 16, the passages 22, 24 respectively being connected to hydraulic high pressure 30 (black color marker) and hydraulic low pressure 32 (gray color marker), and in a manner that the tangential distribution of the passages are adapted the tangential division of the sliders, which at any time in each chamber 18 is a slider 20 which delimits hydraulic high pressure 30 from hydraulic low pressure 32 and with the number of sliders in total, represent more than one per. protrusion.

Sliders 20 may be brought to abutment against the static body by not shown springs, but may alternatively be hydraulically affected to abut the static body in the cavity between two consecutive radial protrusions 16.

In connection with the spinning motion of the rotating part, the sliders 20 will have to pass the protrusions/barriers 16, and with the design of which the protrusions/barriers 16 is shaped, it will be necessary that the sliders 20 are displaced radially before their sides arrives to the protrusions/barriers 16. In a first embodiment said displacement can consist of a hydraulic impact of the sliders in response to differential pressure between the high pressure side 30 and the low pressure side 32 of the hydraulic system connected to the hydraulic motor or pump.

In a second embodiment of the hydraulic motor or pump 2, the radial displacement of the sliders 20 may consist of a mechanical/hydraulic influence.

In a further embodiment of the hydraulic motor or pump 2, the radial displacement of the sliders 20 may consist of an electric/hydraulic influence or an electromechanical/hydraulic influence.

It should be noted that the showed embodiments of the hydraulic motor or pump 2 is described as a motor, but the motor 2 may equally well be used as a hydraulic pressure pump, by imposing a rotational torque on the rotating part.

What is claimed is:

1. Hydraulic motor or pump (2), comprising a first (4) and a second body (6) which in association with final boundaries (8, 10) defines an annular cavity (12) with a constant cross-sectional opening in relation to the centre (14) of the annular cavity (12) where the first body (4) is static and the second body (6) is rotatable, or vice versa, and where the annular cavity (12) is connected with passages (22, 24) respectively to a hydraulic pressure side (30) and a pressure neutral side (32) and where the first or the second body comprises evenly spaced radial projecting protrusions (16) which connecting the bodies and divides the annular cavity (12) in a number of chambers (18) which are alternately placed under hydraulic pressure, and are pressure neutral, characterized in, that the static body (4, 6) comprises a number of evenly spaced, radial protrusions (16) along the annular cavity (12) which is in abutment with the rotatable body (4, 6), and where the rotatable body comprises a number of evenly spaced radial displaceable protruding sliders (20) along the annular cavity (12), said sliders being in abutment with the static object and follows the motion of the rotatable body, where the radial protrusions (16) includes a first passage (22) and a second passage (24) with outflow openings respectively at a first side and at a second side of the respective protrusions, the passages respectively connected to hydraulic high pressure (30) and hydraulic low pressure (32) and so that a tangential division of the passages are adapted the tangential division of the sliders, by which at any time in each chamber there is a slider (20) delimits the hydraulic high pressure (30) from hydraulic low pressure (32), and where a number of sliders (20) represent more than one per protrusion (16).

2. Hydraulic motor or pump (2) according to claim 1, characterized in, that the sliders (20) are spring activated to abutment against the static body.

3. Hydraulic motor or pump (2) according to claim 1, characterized in, that the sliders (20) are hydraulic activated to abutment against the static body in the cavity between two consecutive radial protrusions.

4. Hydraulic motor or pump (2) according to claim 3, characterized in, that the sliders (20) are hydraulic activated for radial displacement in a manner that a current slider (20) during passage of a current protrusion (16) does not affect the sides (26, 28) of the protrusion.

5. Hydraulic motor or pump (2) according to claim 3, characterized in, that the sliders (20) are mechanical/hydraulic activated for radial displacement that a current slider (20) during passage of a current protrusion (16) does not affect the sides (26, 28) of the protrusion.

6. Hydraulic motor or pump (2) according to claim 3, characterized in, that the sliders (20) are electric/hydraulic activated for radial displacement that a current slider (20) during passage of a current protrusion (16) does not affect the sides (26, 28) of the protrusion.

* * * * *